United States Patent [19]

Kadija

[11] 4,415,416

[45] Nov. 15, 1983

[54] ELECTROCHEMICAL DEPYROPHORIZATION OF RANEY NICKEL ELECTRODES

[75] Inventor: Igor V. Kadija, Cleveland, Tenn.

[73] Assignee: Olin Corporation, New Haven, Conn.

[21] Appl. No.: 373,470

[22] Filed: Apr. 30, 1982

[51] Int. Cl.[3] ..... C23F 13/00; C25B 11/00

[52] U.S. Cl. ..... 204/147; 204/290 R; 204/293

[58] Field of Search ..... 204/140, 147, 293, 290 R

[56] References Cited

U.S. PATENT DOCUMENTS

| | | | |
|---|---|---|---|
| 1,127,911 | 2/1915 | Morey | 252/411 R |
| 2,810,666 | 10/1957 | Gleason | 148/6.14 |
| 3,379,635 | 4/1968 | von Doehren et al. | 204/284 |
| 3,573,038 | 5/1971 | Jung et al. | 75/211 |
| 3,673,116 | 6/1972 | Richter | 252/466 T |
| 3,674,710 | 7/1972 | Richter et al. | 252/465 |
| 4,162,949 | 7/1979 | Hine | 204/140 |
| 4,177,129 | 12/1979 | Kwo | 204/293 |
| 4,224,248 | 9/1980 | Birkenstock et al. | 260/580 |
| 4,240,895 | 12/1980 | Gray | 204/290 R |

*Primary Examiner*—John F. Niebling

*Attorney, Agent, or Firm*—Arthur E. Oaks; Donald F. Clements

[57] ABSTRACT

An electrochemical oxidation treatment for monolithic cathode structures having a Beta phase Raney nickel alloy surface thereon is disclosed. When a freshly leached structure is made the anode in an electrochemical cell, which is operated at a current density of between about 40 and about 60 mA/cm$^2$ until the polarization voltage is reduced from the open circuit value of about −1250 mV by about 500 to about 700 mV, the treated structure is free of subsequent problems with pyrophoricity. Cathodic structures treated this way show substantially no difference in hydrogen overvoltage characteristics and long-term stabilities when compared to chemically depyrophoricized materials of the same composition and structure.

9 Claims, 2 Drawing Figures

ELECTROCHEMICAL DEPYROPHORIZATION OF RANEY NICKEL ELECTRODES

The invention relates to metallic electrodes containing catalytic surfaces, particularly to monolithic structures having an integral Raney nickel alloy surface thereon and more particularly to a process for treating such catalytic surfaces so as to eliminate their pyrophoric properties without significantly affecting their electrolytic utility.

Porous catalysts, such as Raney nickel, though highly active and utilized to a significant extent in industry, are limited in their employment because of their pyrophoric properties. Such catalysts, when activated and exposed to an oxidizing atmosphere, particularly to air, react so rapidly that they frequently become incandescent and/or lose their catalytic activity. Consequently, in powdered or granular form, these catalysts are generally stored under a liquid such as alcohol or water to protect them until they can be used. At the time of their utilization, however, they usually must be transferred to an operating system. This is generally a lengthy and delicate operation and one which can considerably increase the cost of, and reluctance to, employing such catalysts.

As a result of the difficulties attendant to the employment of pyrophoric granulated catalysts, there is a general industrial preference to the use of catalytic structures which have the active material deposited onto more or less "monolithic" supports such as $Al_2O_3$. Because of the relative ease with which they can be handled, these find wide use notwithstanding the fact that the catalytic activity of such supported catalysts is usually lower than "pure" Raney nickel catalysts per se. Further, supported catalysts can produce undesirable side reactions due to the catalytic activity of the support material.

The process of Raney metal preparation includes the step of dissolving a leachable metal such as aluminum, lead, or zinc from an alloy of said leachable metal with a metallic structure with a strong caustic solution so as to form a highly porous catalytically active structure on the surface thereof. In modern chlor-alkali cells, Raney nickel cathodes prepared from an alloy of nickel and between about 5 to about 20 percent by weight of molybdenum, ruthenium, tantalum, titanium or mixtures thereof, are finding wide use, particularly when such an alloy also serves as a monolithic substrate. In these, there is an integral coating of a Beta phase Raney nickel alloy surface which is generated directly from the substrate material. Such a structure is shown by Gray in U.S. Pat. No. 4,240,895 which is incorporated herein by reference. In these structures, activation normally requires that about 80 to about 90 percent of the leachable metal be removed before use. When such a structure is leached to this extent, copious evolution of hydrogen occurs so that there is frequently a considerable amount of interstitial hydrogen retained within the porous Raney alloy surface, said amount often reaching to between about 12 and about 14 ml/cm$^2$ of surface coating. If Raney nickel alloy in this condition is subsequently exposed to air, the hydrogen will quickly react with the oxygen in the air and ignite the coating. This produces quite deleterious affects on the catalytic activity of the structure, due to conversion and sintering of the nickel to inactive, frangible and nonporous nickel oxides. In cathodes for chlor-alkali sevice, such a condition quickly leads to failure by spallation of the Raney coating.

Realizing this problem, investigators have developed a number of methods in an attempt to lessen the sensitivity of Raney catalysts to air. For example, one suggestion is to treat such materials with an inert gas containing traces of one or more oxidizing gases and gradually increasing the proportion of the oxidant with respect to time. However, from an operational standpoint, this process must be operated very slowly to avoid an excessive increase in temperature. Even so, it does not prevent the occasional appearance of local hot spots which are exceptionally difficult to detect, much less control. Thus, it is impossible, for all practical purposes, to maintain a uniform level of activity in a catalyst material so treated.

Other techniques have been developed utilizing relatively dilute solutions of various chemical oxidizing agents, such as sodium hypochlorite, sodium nitrate, potassium dichromate, hydrogen peroxide, etc. However, these often result in highly irregular results with respect to the reduction of pyrophoric properties and sometimes leaves coatings which act to inhibit or modify catalytic activity. Even if the catalyst per se is not affected, the use of these materials frequently introduces some degree of contamination into the catalyst system which may result in later problems with the purity of the catalytically produced product. These problems are particularly significant when one is dealing, not with a granular catalyst used for fluidized bed and similar applications, but rather with a large monolithic structure, such as the cathode described hereinabove.

In addition to the chemical conversion methods, U.S. Pat. No. 3,674,710, issued to Richter et al on July 4, 1972, discloses an electrochemical process wherein a granular Raney nickel alloy, which is first compacted to form a cathode adapted for fuel cell use, is depyrophoricized. This is done by the slow anodic oxidation of the structure so as to decrease (i.e. make more positive) the normal −1250 mV open circuit anodic polarization voltage by about 100 to 1000 mV, i.e. to a final value of between −1150 to −250 mV, and preferably by about 100 to 150 mV to a final value of −1150 to −1000 mV. When this is done over a treatment time of between 10–12 hours, the problem with pyrophoricity is reported to be effectively removed.

When one is dealing with large monolithic structures, the difficulties in first fabricating such a structure and then handling it in such a way so as not to damage the surface coating create significant problems in effectively treating them to remove their pyrophoric tendencies. It has been found that the method defined as preferred by Richter et al, when applied to such structures, is inadequate. This is because such a relatively low reduction in the anodic polarization voltage, when applied to the activated, porous surface of such a structure, does not remove a sufficient amount of the hydrogen adsorbed with the coating structure to provide adequate protection against subsequent pyrophorization. Further, it has been shown that anodic exposure for such a long period of time weakens the bonding of the coating thus creating an increased tendency for subsequent failure by spallation.

These problems are acerbated if this procedure for reducing anodic polarization is carried out to the upper end of Richter et al's disclosed range, namely to a negative voltage decrease in the range of about 900 to 1000 mV. At this value, it is found that such a treatment tends to attack and deplete the molybdenum content in the surface coating and embrittle it so that there is a reduction in both catalytic efficiency and service life stability. As a result, the aforementioned chemical treatment methods with all of their disadvantages continue to be used for such structures. A procedure for chemically treating large cathodes of this type is described by Gray in U.S. Pat. No. 4,240,895.

What is needed is a more precise and quicker method for treating such structures which both does not introduce foreign materials in the process stream and which is adaptable to being safely applied to large monolithic Raney nickel alloy coated structures.

SUMMARY OF THE INVENTION

It is an object of this invention to provide a depyrophorization method for treating large monolithic structures having an integral Raney catalyst on the surface thereof with an electrochemical method which is both adaptable to such structures and which does not leave any chemical residues thereon at the conclusion thereof.

It is also an object of the subject invention to provide an electrochemical oxidative depyrophorization treatment for safely treating monolithic catalytic cathodes of the type used for chlor-alkali cells, said cathodes having an integral Raney nickel alloy surface thereon, said treatment inducing a controlled oxidation and removal of hydrogen which is adsorbed within the porous structure of a freshly leached Raney surface.

These and other objects of the subject invention will be apparent after reading the following description taken in conjunction with the drawings.

It has been found that pyrophoricity can be reduced or eliminated by a method which involves, after leaching the leachable metal from the precursor alloy, installing the still wet electrode as the anode in an electrolytic cell and operating the cell at a current density of between about 30 and about 100 mA/cm$^2$ so that the normal negative anodic polarization voltage reading relative to a saturated calomel electrode (SCE) control electrode is reduced from the open circuit value by about 500 to about 700 mV and preferably by about 550 to about 600 mV. Under these conditions, such a procedure takes between about 15 minutes and about 1 hour and not only rapidly reduces the amount of interstitial hydrogen to a level where problems with pyrophoricity do not occur in large monolithic Raney nickel alloy coated structures but does so in a manner that their utility for application as cathodes for chlor-alkali cell service is unaffected.

DETAILED DESCRIPTION OF THE INVENTION

The method of this invention overcomes the problem of pyrophoricity in large monolithic Raney nickel alloy coated structures by an electrolytic treatment adapted to reduce the negative open circuit voltage of about −1250 mV by between about 500 and about 700 mV while minimizing potential damage to the coating. This is done by using a current density of between about 10 and about 100 mA/cm$^2$ which corresponds to about 0.1 to about 1 KA/m$^2$, and preferably between about 40 and about 60 mA/cm$^2$ so as to keep total exposure time to a minimum. It is found that by so doing, interstitial hydrogen is safely and quickly reduced to a level where it is insufficient to create the above-mentioned self-ignition and degradation problems.

Figure 1:
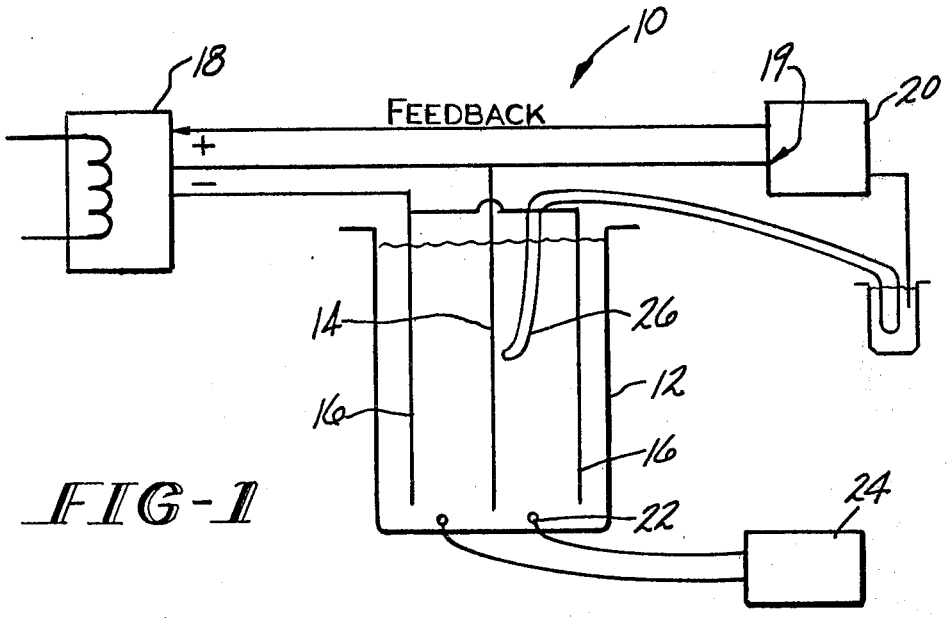
FIG. 1 is a diagram of an apparatus for electrolyzing a monolithic Raney nickel alloy electrode to prevent pyrophoric oxidation of self-ignition thereof.

The apparatus, wherein this is done, is illustrated in FIG. 1. As shown, electrolytic apparatus 10 comprises electrolytic cell 12 having a central freshly leached, still wet Raney nickel alloy anode 14, which is to be depyrophoricized, sandwiched between a pair of cathodes 16, the whole of cell 12 being substantially filled with a 25–35 percent caustic soda solution. Anode 14 is connected both to the positive terminal of rectifier 18 and to the wiper of middle terminal 19 of potentiometer 20. Both cathodes, which can be made of any suitable caustic resistant conductive material such as steel or copper, are connected to the negative terminal of rectifier 18.

At the bottom of cell 12, there are a plurality of inlets 22 which are connected to inert gas source 24, said inert gas being admitted to the bottom of the cell so that it creates turbulence within the solution surrounding the electrodes. This prevents incorrect voltage readings by carrying away any impedance raising bubbles of oxygen and hydrogen which would otherwise form on the anode and cathode surfaces. Also fitted within the cell is reference SCE electrode 26, said electrode being positioned so as to be adjacent to and able to read the polarized voltage of anode 14, and further connected electrically to one end of potentiometer 20. The other end of potentiometer 20 is connected to rectifier 18 and is adapted to respond to the change in anodic polarization voltage of anode 14 from its open circuit value as electrolysis proceeds and further to cooperate with rectifier 18 so as to stop the procedure when the negative anodic polarization voltage is decreased by a value of about 500 to about 700 mV, referenced to the open circuit SCE voltage.

Figure 2:
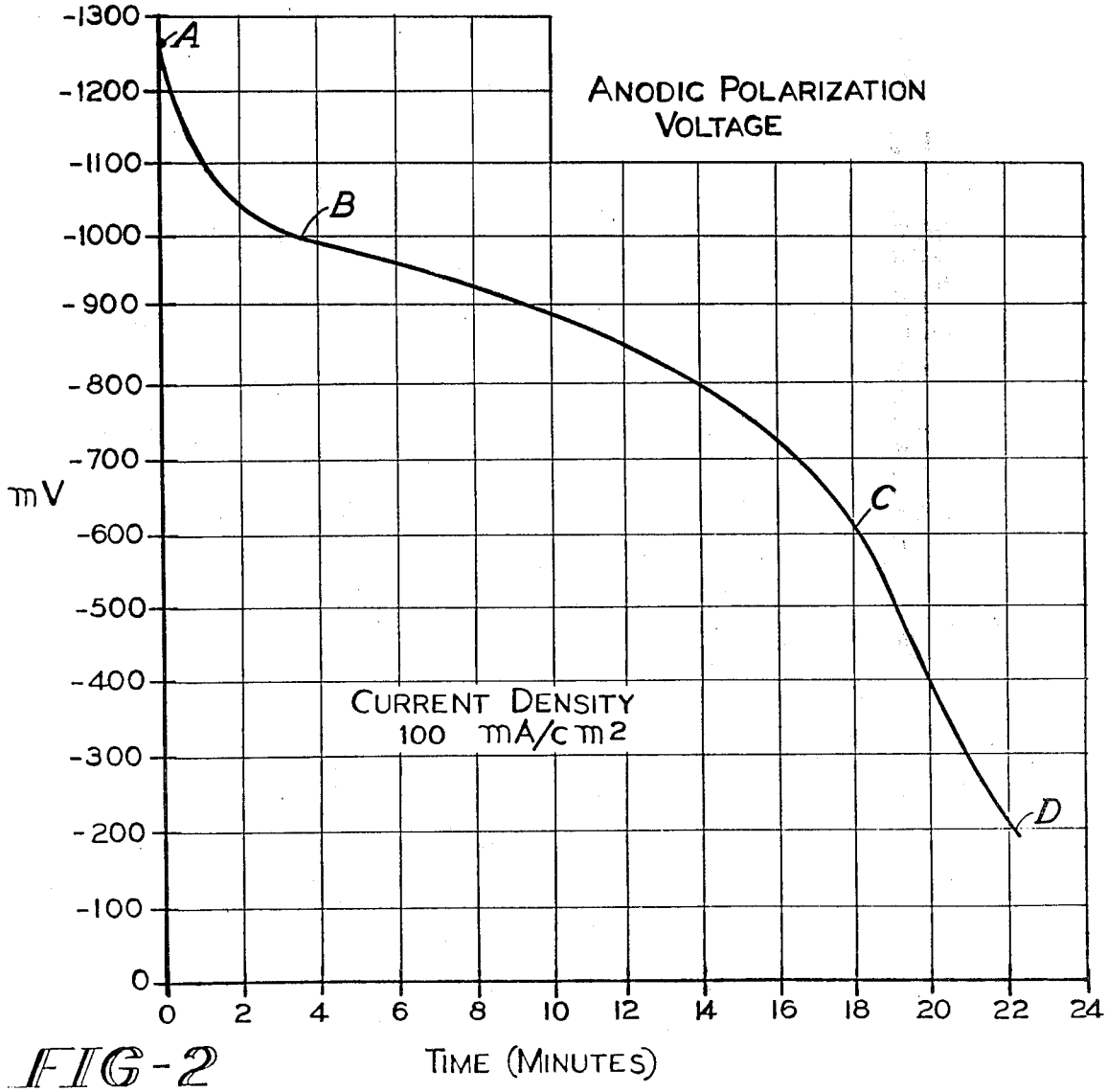
FIG. 2 is a curve showing the change as a function of time in the anodic polarization voltage of a Raney alloy cathode when treated in the apparatus of FIG. 1 at a current density of about 100 mA/cm$^2$.

When the procedure noted above is carried out, the anodic polarization voltage follows a curve similar to that shown in FIG. 2 starting at the open circuit voltage, shown as point A. For monolithic cathodic structures intended for chlor-alkali service, this is normally between about −1200 and about −1300 mV. At the start of electrolysis, the anodic polarization voltage quickly drops by about 200 mV to point B at which point the rate of change in said anodic polarization voltage becomes considerably slower as it progresses through points C and D. No reason is known for this change in the rate of anodic polarization voltage reduction at point B but it may be related to differences in the relative ease with which "surface" hydrogen as contrasted to "interstitial" hydrogen can be removed. Under the conditions of applicant's procedure, it is found that anodic polarization voltage decreases of from about 500 to about 700 mV are reached in about 16 to about 20 minutes of treatment time at a current density of about 100 mA/cm$^2$. For lower current densities, the exposure time will be longer, reaching a time of about 1 hour at a current density of about 30 mA/cm$^2$.

The utility of this method is shown by the following examples.

EXAMPLE 1

A freshly leached monolithic Raney electrode comprised of an integral Beta structured Raney alloy surface on a substrate comprised of nickel alloyed with about 12 percent molybdenum and having a surface area of about 50 $cm^2$ was placed in apparatus 10 as anode 14. When measured by SCE electrode 26, the open circuit voltage was about −1250 mV. Rectifier 18 was then turned on with a current density of about 100 $mA/cm^2$. The cutoff voltage, which was set at about 600 mV (point C of FIG. 2) was reached in about 18 minutes after which time the Raney coating exhibited no problems with either pyrophoricity or frangibility when it was removed from the system. Further, this electrode showed no differences in hydrogen overvoltage characteristics as compared to chemically treated cathode materials having a similar composition and structure, when used as a cathode in a chlor-alkali membrane cell.

EXAMPLE 2

The procedure of Example 1 was repeated except that the run was terminated when a positive reduction of about 200 mV (point B of FIG. 2) relative to the SCE voltage was reached. This took about 4 minutes at the conclusion of which the anode was removed and dried. It was found that the pyrophoric nature of the coating had not been eliminated and it began to burn.

EXAMPLE 3

The procedure of Example 1 was reproduced with exception that the cutoff voltage was changed to be about 1000 mV below the SCE voltage (point D of FIG. 2). This took about 22 minutes at the conclusion of which it was found that there was a noticeable accumulation of metallic powder in the bottom of the cell. Also, the coating on the anode was extremely fragile and would flake off with only a slight amount of shaking after it had dried.

From this, it can be seen that despite the prior art teaching of efficacy over the entire range of about 100 to about 1000 mV reduction in the anodic polarization voltage for Raney catalytic materials, such is not the case when one is dealing with large monolithic structures of the types discussed above. For these very different conditions as defined herein are required.

This invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

I claim:

1. In an electrolytic method for depyrophoricizing a Raney nickel alloy electrode material, characterized by installing said electrode as an anode in an electrolytic cell and operating said cell to reduce the anodic polarization voltage so that it will not self-ignite, the improvement which comprises preparing as said electrode a monolithic Beta structured Raney nickel alloy structure having a Raney nickel alloy catalytic surface integral with a nickel alloy substrate containing from about 5 to about 20 percent by weight of an alloying metal selected from the group consisting of molybdenum, ruthenium, tantalum, titanium or mixtures thereof, and operating said cell at a current density of between about 10 and about 100 $mA/cm^2$ until the nominal negative anodic polarization voltage of said electrode is reduced by about 500 to about 700 mV below the nominal open circuit voltage for said cell.

2. A method for depyrophoricizing a monolithic Beta structured Raney nickel alloy catalytic surfaced cathode material wherein said surface is integral with a nickel alloy substrate, said substrate containing from about 5 to about 20 percent by weight of a metal selected from the group consisting of molybdenum, ruthenium, tantalum, titanium or mixtures thereof, said method comprising:

a. attaching said cathode as the anode of an electrolytic cell, said cell having an anode and at least one cathode;

b. measuring the open circuit anodic polarization voltage between the anode and cathode of said cell; and c. operating said cell at a current density of between about 10 and about 100 $mA/cm^2$ until said anodic polarization voltage has been reduced by about 500 to about 700 mV relative to said open circuit voltage.

3. The method of claims 1 or 2 wherein said substrate alloy metal is molybdenum.

4. The method of claim 1 wherein said current density is between about 40 and about 60 $mA/cm^2$.

5. The method of claim 1 wherein said anodic polarization voltage reduction is between about 550 and about 600 mV.

6. The method of claim 1 wherein the time for said voltage is between about 16 and about 60 minutes.

7. The method of claim 2 wherein said current density is between about 40 and about 60 $mA/cm^2$.

8. The method of claim 2 wherein said anodic polarization voltage reduction is between about 550 and about 600 mV.

9. The method of claim 2 wherein the time for said voltage is between about 16 and about 60 minutes.

* * * * *